US006109140A

United States Patent [19]

Roberts et al.

[11] Patent Number: 6,109,140

[45] Date of Patent: Aug. 29, 2000

[54] RATCHET WRENCH

[75] Inventors: Peter M. Roberts, Red Bank, Tenn.; John B. Davidson, Chicago, Ill.

[73] Assignee: Joda Enterprises, Inc., Chicago, Ill.

[21] Appl. No.: 09/229,206

[22] Filed: Jan. 13, 1999

Related U.S. Application Data

[60] Provisional application No. 60/081,268, Apr. 9, 1998.

[51] Int. Cl.[7] ..... B25B 13/46

[52] U.S. Cl. ..... 81/63; 81/63.2; 81/177.85

[58] Field of Search ..... 87/63, 63.2, 177.85

[56] References Cited

U.S. PATENT DOCUMENTS 3,208,318 9/1965 Roberts .
4,277,990 7/1981 Hall .
4,420,995 12/1983 Roberts .
4,934,220 6/1990 Slusar et al. ..... 81/63.2
5,000,066 3/1991 Gentiluomo ..... 81/63 X
5,390,571 2/1995 Fox et al. ..... 81/177.85

*Primary Examiner*—James G. Smith
*Attorney, Agent, or Firm*—Brinks Hofer Gilson & Lione

[57] ABSTRACT

A ratchet wrench including a handle, a drive stud and a ratchet mechanism further includes a tool release mechanism. The tool release mechanism includes a control rod that slides along the centerline of the drive stud and a ramp that is slidable in a plane transverse to the drive stud axis. The illustrated actuator is confined to the region of the ratchet wheel, and does not move between the pawl of the ratchet mechanism and the head of the wrench. Centering elements extend from the head of the wrench into an annular recess on a face of the ratchet wheel opposed to the drive stud. The actuator moves in a gap formed between opposed portions of the centering element.

28 Claims, 4 Drawing Sheets

23
32
24
41
42
40
44
30
31
3
4
21
22
8
2
12
17
16
5
9
11
17
3
4

40
41
1
6
22
44
2
9
18
19
7
16
2

RATCHET WRENCH

This appln claims the benefit of U.S. Provisional Ser. No. 60/081,268 filed Apr. 9, 1998.

BACKGROUND

The present invention relates to ratchet wrenches such as socket wrenches, and in particular to ratchet wrenches with improved tool release mechanisms that resist inadvertent operation and to ratchet wrenches with improved means for holding the ratchet wheel in engagement with the pawl.

U.S. Pat. No. 3,208,318 discloses an effective tool release mechanism for tools such as sockets. In the disclosed system a control rod is axially slidable in a drive stud of the wrench, and the control rod defines a ramp surface on which a ball rides. A spring biases the control rod outwardly to a rest position, in which the ball positively engages an accommodating recess in a tool such as a socket. When it is desired to release the socket from the drive stud, the control rod is depressed against the biasing force of the spring, thereby allowing the ball to move down the ramp to a position that allows removal of the socket.

The tool release mechanism of the above-identified patent has been found to be reliable and effective in use. However, the possibility exists that under some circumstances a user may inadvertently depress the control rod while using the wrench. This may happen for example if the head of the wrench is placed in the palm of the user's hand. In this case the palm of the user's hand can come into contact with the upper end of the control rod, and can inadvertently depress the control rod while the wrench is in use, thereby inadvertently releasing the socket. One object of certain embodiments described below is to overcome this potential drawback of the prior art.

Roberts U.S. Pat. No. 4,420,995 discloses a tool release mechanism for tools such as sockets. In the disclosed ratchet mechanism a ratchet wheel is provided with an annular raised boss on the side of the ratchet wheel opposite the drive stud, and this boss fits within a recess in the head of the wrench. The boss resists forces tending to decenter the ratchet wheel with respect to its axis of rotation.

SUMMARY

The present invention is defined by the following claims, and nothing in this section should be taken as a limitation on those claims. By way of introduction, the embodiments described below include a quick release mechanism that is controlled by an actuator mounted in the head of the ratchet wrench. The actuator moves in a plane substantially transverse to the axis of rotation of the ratchet wheel to operate the quick release mechanism.

In the preferred embodiment described below, the actuator is configured to avoid moving between the pawl of the ratchet mechanism of the wrench and the head of the wrench as the actuator moves in the plane. This increases the space available for an interface between the pawl and the ratchet wrench without unnecessarily increasing the thickness of the head of the ratchet wrench. If desired, the ratchet wheel can be centered by a centering element that extends at least partly around the axis and extends from the head of the wrench into an annular recess formed on a side of the ratchet wheel opposite the drive stud.

DETAILED DESCRIPTION OF THE PRESENTLY PREFERRED EMBODIMENTS

Figure 2:
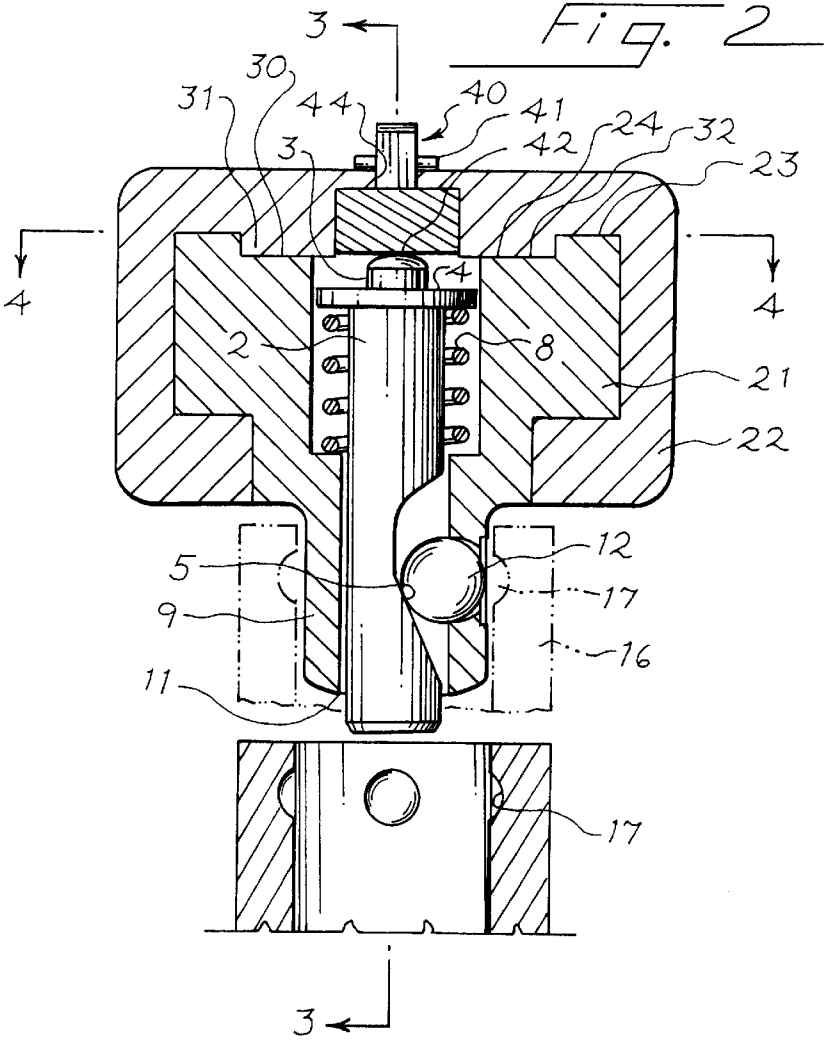
FIG. 2 is a cross-sectional view taken along line 2—2 of FIG. 1.
Figure 1:
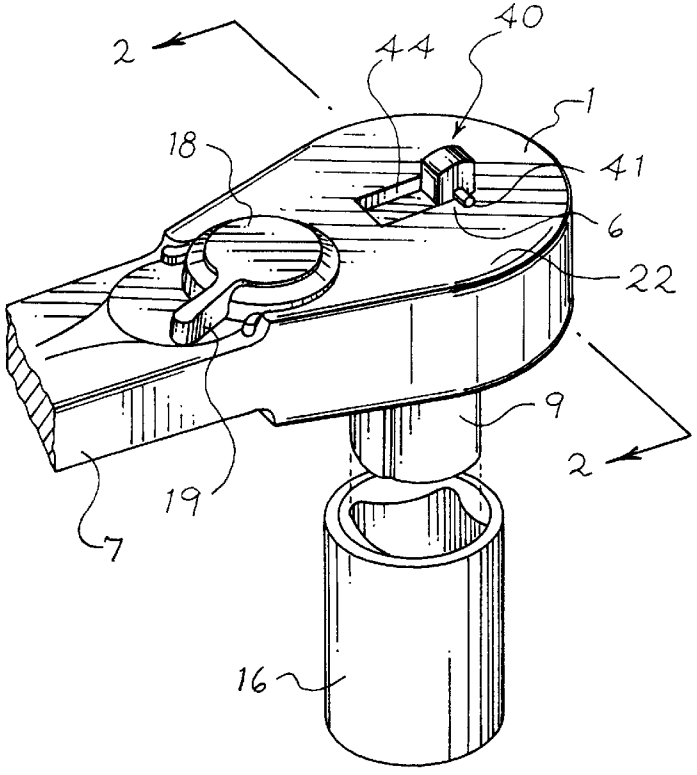
FIG. 1 is a perspective view of a ratchet wrench that incorporates a presently preferred embodiment of this invention.

Turning now to the drawings, FIG. 1 shows a perspective view of a ratchet wrench 1 that incorporates a preferred embodiment of this invention. The ratchet wrench 1 includes a handle 7 that supports a drive stud 9 for rotation. A ratchet mechanism (not shown in FIG. 1) controls rotation of the drive stud 9 with respect to the handle 7. The drive stud 9 is shaped and dimensioned to be received by an out-of-round opening in a tool such as a socket 16. As best shown in FIG. 2, the drive stud 9 carries a control rod 2 that slides within a passageway 11. The control rod 2 defines a head 3 and a flange 4, which may be respective surfaces of a single element. A spring 8 bears between the flange 4 and a shoulder on the passageway 11 to bias the control rod 2 upwardly in the orientation shown in FIG. 2.

The control rod 2 also defines a ramp 5 that bears against a ball 12. When the ball 12 is positioned at a more recessed portion of the ramp 5, the ball 12 can move entirely inside the drive stud 9 to allow a socket 16 to be inserted on and removed from the drive stud 9. See FIG. 2. Conversely, when the control rod 2 is biased to the position shown in FIG. 5, the ball 12 rests on a less recessed portion of the ramp 5, and the ball 12 protrudes partly out of the drive stud 9 into a recess 17 in the socket 16. In this way the ball 12 positively retains the socket 16 on the drive stud 9. The control rod 2 can be taken as an example of a tool release actuator and the ball 12 can be taken as an example of a tool retention element. The control rod 2 and the ramp 5 provide selective alignment of the ball 12 for each individual socket 16.

Returning to FIG. 1, the wrench 1 also includes a reversing lever 18 that can be used to control the ratchet mechanism of the wrench 1. The reversing lever 18 includes a handle 19.

Figure 4:
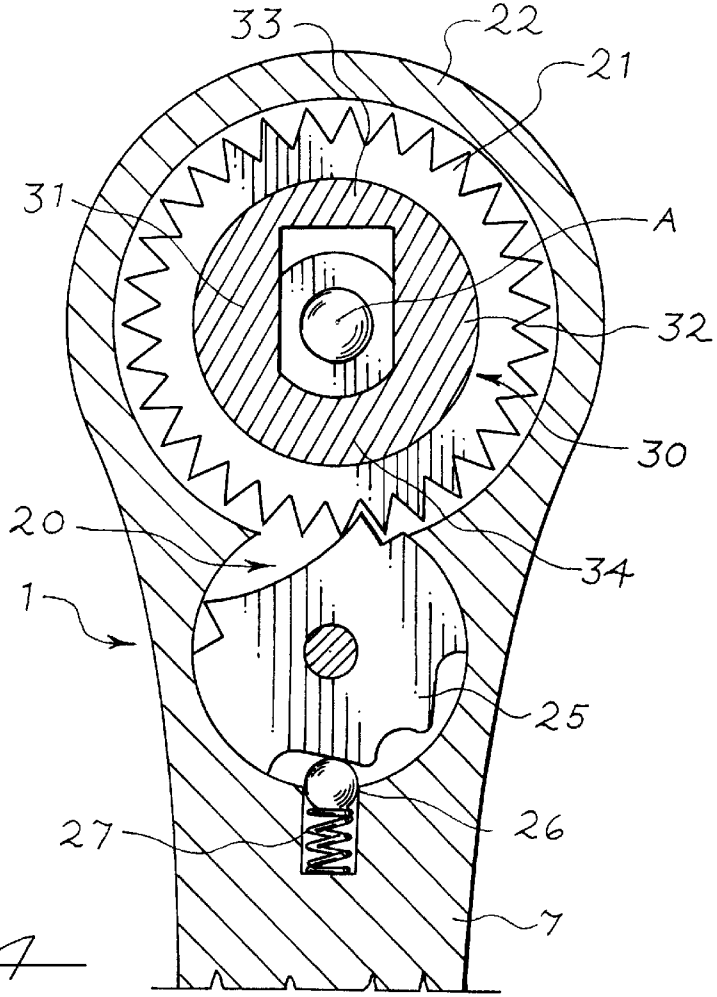
FIG. 4 is a cross-sectional view taken along line 4—4 of FIG. 2.
Figure 3:
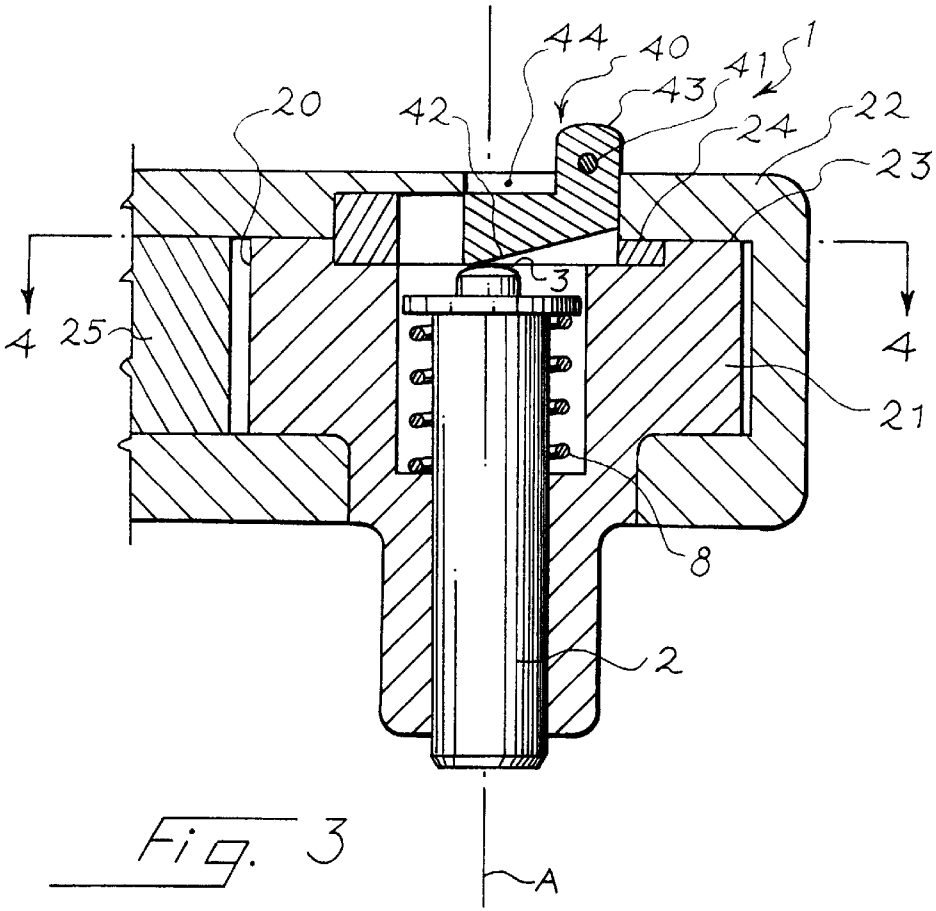
FIG. 3 is a cross-sectional view taken along line 3—3 of FIG. 2.

FIGS. 2, 3 and 4 show cross-sectional views in respective planes of the ratchet wrench 1. As shown in these figures, the ratchet wrench 1 includes a ratchet mechanism 20 that engages a ratchet wheel 21 mounted in a recess in the head 22 of the wrench 1 for rotation about an axis A. As shown in FIGS. 2 and 3, the ratchet wheel 21 includes a face 23 on a side of the wheel 21 opposite the drive stud 9, and this face 23 defines an annular recess 24.

As best shown in FIG. 4, the ratchet mechanism 20 includes a pawl 25 that is movable by the reversing lever 18 of FIG. 1 into any one of three functional positions: forward, neutral, reverse. A detent ball 26 backed by a spring 27 resiliently holds the pawl 25 in any one of these three positions. In the neutral position the pawl 25 is held out of contact with the ratchet wheel 21, preventing ratcheting action and if desired allowing free-wheeling motion of the ratchet wheel 21 and the drive stud 9 with respect to the handle 7. In the forward and reverse positions the pawl 25 allows only one-direction rotation of the ratchet wheel 21 in the forward and reverse directions, respectively.

As best shown in FIGS. 2 and 4, the head 22 of the wrench 1 defines a centering element 30 comprising first and second portions 31, 32 that extend toward the ratchet wheel 21 and are received within the recess 24. The first and second portions 31, 32 of the centering element 30 are interconnected by additional portions 33, 34, as best shown in FIG. 4, such that the centering element 30 extends continuously around the axis A. The centering element 30 engages the ratchet wheel 21 to center the ratchet wheel 21 against torques and other applied loads tending to decenter the ratchet wheel 21 with respect to the axis A. In general, the centering element is shaped to center the ratchet wheel 21 against yawing movement away from the pawl 25 that would interfere with effective engagement between the ratchet wheel and the pawl. Additionally, if desired the centering element 30 can be shaped to center the ratchet wheel 21 in other directions, such as movement toward the pawl and/or movement at right angles to a line extending between axis A and the pawl.

As shown in FIG. 4, in this embodiment the additional portion 33 of the centering element 30 is of reduced thickness to accommodate the motion of the ramp 42 described below. The additional portion 34 in this embodiment is of substantially constant radial thickness, and it is the additional portion 34 that is best placed to resist de-centering movement of the ratchet wheel 21 away from the pawl 25. In other embodiments one or both of the additional portions 33, 34 can be entirely eliminated, leaving gaps between the first and second portions 31, 32 of the centering element 30. Alternately, the centering element can be horseshoe shaped. Whether or not gaps or notches are provided in the centering element 30, and if so, the number of such gaps or notches in the centering element 30, as well as the radial thickness of the parts of the centering element 30, can vary widely, depending upon the application.

The quick release mechanism including the control rod 2 and the ball 12 is controlled by an actuator 40 that is best shown in FIG. 3. The actuator 40 includes a ramp 42 that is movable for engagement with the head 3 of the control rod 2, and a control surface 43 that is exposed at an exterior portion of the head 22. The actuator 40 is additionally guided in linear motion transverse to the axis A by a slot 44 formed in the head 22. Alternately, the actuator 40 can be guided by the first and second portions 31, 32 of the centering element 30. The control surface 43 extends to an exterior portion of the head 22 through the slot 44. Preferably, the actuator 40 is mechanically prevented from moving into the head 3. This function can be accomplished by any suitable mechanical interlock, but a roll pin 41 is used in this preferred embodiment. Another alternative is to provide a clamp such as a clamping C-ring extending around a neck of the actuator 40 protruding through the head 22 to secure the actuator 40 in place against undesired axial movement along the direction of the axis A. Either the actuator 40 or the head of the wrench 1 can alternately be provided with overlapping flanges.

Figure 5:
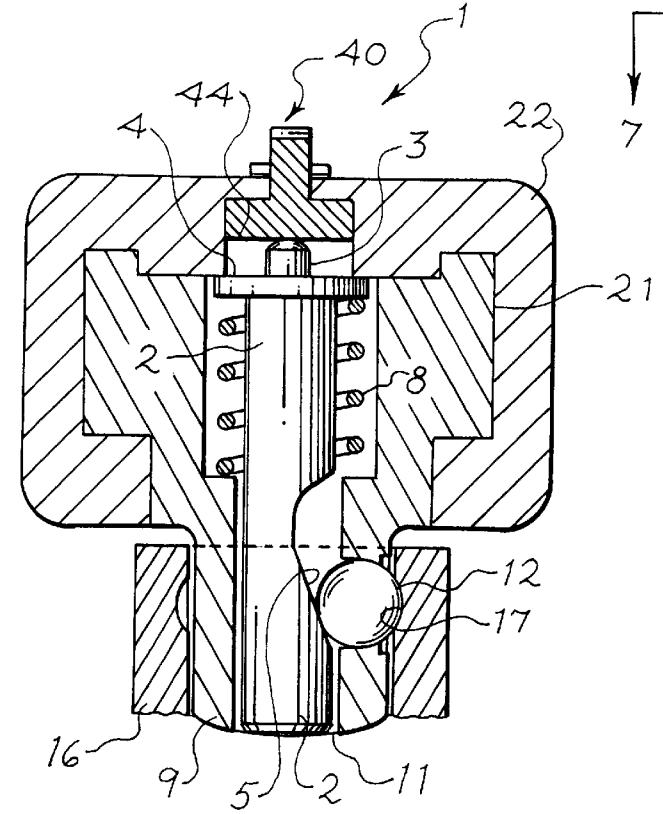
FIG. 5 is a cross-sectional view of the wrench of FIG. 1 taken in the plane of FIG. 2 and showing the quick release mechanism in an alternate position.

The operation of the quick release mechanism will be explained with relation to FIGS. 2, 3 and 5. FIGS. 2 and 3 show the quick release mechanism in a first position, in which the actuator 40 has been pushed away from the reversing lever 18 (see FIG. 1). In this position, the thick end of the ramp 42 bears on the head 3 of control rod 2, thereby forcing the control rod 2 downwardly in the orientation of FIG. 3, compressing the spring 8 and allowing the ball 12 to move entirely within the drive stud 9 (FIG. 2). The other extreme of travel is shown in FIG. 5, in which the thin portion of the ramp 42 is aligned with the axis A. In this position of the actuator 40 the spring 8 pushes against the flange 4 to move the control rod 2 upwardly in the configuration of FIG. 5, thereby urging the ball 12 into the recess 17 of the socket 16. The ramp 42 can take any suitable form, and can be curved, stepped, or linear.

The actuator 40 can be arranged to move along an arc rather than a line, and the direction of motion can be varied as desired. One or more springs (not shown) can be used to bias the actuator 40 to the position of FIG. 5. Additionally or alternatively, the ramp 44 can be notched to provide a detent action with the head 3 in order to hold the actuator 40 in any one of a plurality of selected positions. Also, the ramp may be shaped to release a tool when the actuator is moved toward the reversing lever.

The actuator 40 of FIGS. 2, 3 and 5 moves between the centering element portions 31, 32 best shown in FIG. 4. The centering element portions 33, 34 are shaped to allow the desired range of motion for the actuator 40. In this embodiment the centering element portion 33 is of reduced radial thickness, thereby forming a notch or recess in the centering element 30.

It should be understood that not all embodiments require the use of a centering element 30, and if desired the ratchet wheel 21 can be centered entirely by surfaces adjacent the drive stud 9. However, the use or addition of a centering element 30 on the side of the ratchet wheel 21 opposite the drive stud 9 is preferred for many embodiments.

As shown in FIG. 3, the actuator 40 of this embodiment is confined to the region between the ratchet wheel 21 and the head 22, and the actuator 40 is configured never to intersect a line oriented parallel to the axis A and passing through an interface between the ratchet wheel 21 and the head 22. This actuator 40 is never interposed between the pawl 25 and the head 22. This arrangement provides the advantage that the pawl 25 can extend over the full height of the ratchet wheel 21, and that undesirable reductions in the thickness of the interface between the pawl and the ratchet wheel are thereby avoided. During use the torques applied to the drive stud 9 act directly on the pawl 25, and it is therefore important that the pawl 25 be dimensioned to support adequate torque loads. This design objective can be readily fulfilled without undesirably increasing the thickness of the head 22 in the illustrated embodiment.

The actuator 40 of this embodiment provides the advantage that it is easily manipulated by the user to release or engage a socket. Inadvertent operation is reduced or eliminated. For example, when the head of the wrench is placed in the palm of the hand of the user during use, axial pressure of the palm on the actuator 40 does not result in inadvertent movement of the control rod 2.

Figure 6:
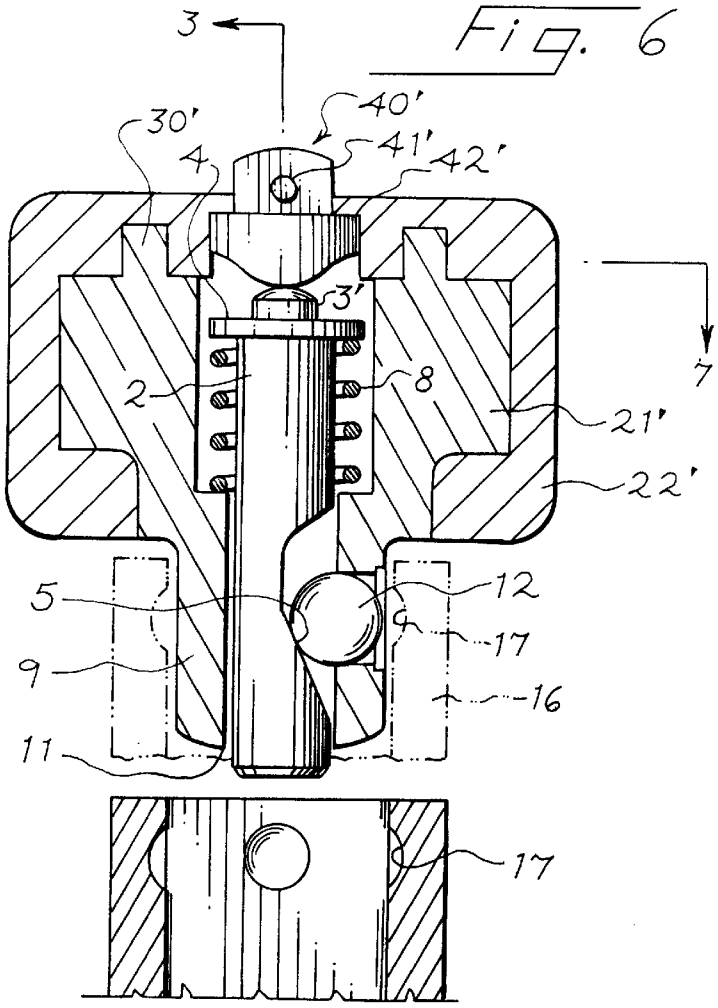
FIG. 6 is a cross-sectional view of a ratchet wrench that incorporates a second preferred embodiment.
Figure 7:
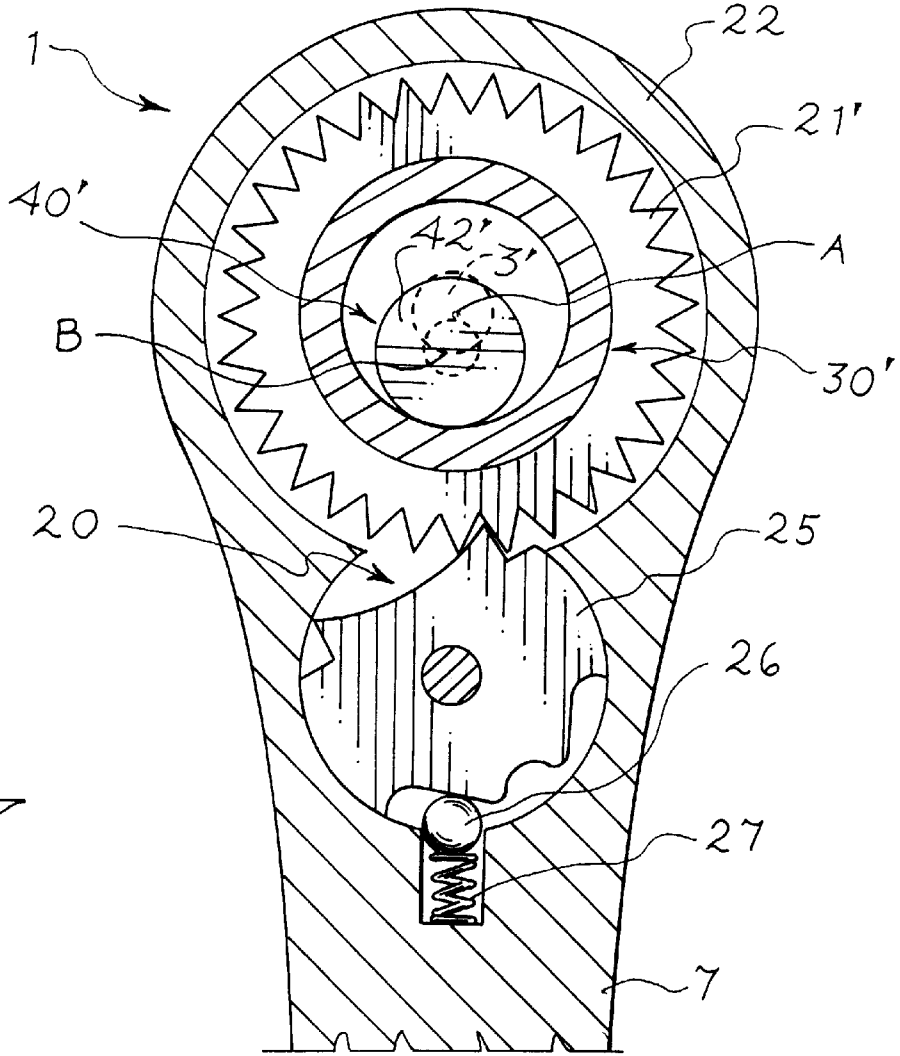
FIG. 7 is a cross-sectional view taken along line 7—7 of FIG. 6.

FIGS. 6 and 7 show two views of a second preferred embodiment of this invention that is in many ways similar to the first embodiment discussed above. Comparable elements are provided with the same reference numeral, and related elements that have been modified are provided with the same reference numeral including a prime symbol.

In this embodiment the actuator 40' is guided by the head 22' for rotary motion about an actuator axis B, as best shown in FIG. 7. The actuator 40' is maintained in position as shown in FIG. 6 by a roll pin 41', and the inner portion of the actuator 40' forms an annular ramp 42' which operates as a cam surface against the head 3' of the control rod 2. FIG. 7 best shows the arrangement between the circular ramp 42' and the head 3'. As shown in FIG. 7, the actuator 40 is held out of contact with the centering element 30'.

The ratchet wheel 21' is centered against forces tending to move it off center with respect to the axis A by a centering element 30' that in this embodiment is formed as a continuous annular ring received in a mating recess in the head 22'. In this embodiment the centering element 30' extends continuously around the actuator 40'.

The invention is not limited to the particular tool release mechanisms and ratchet mechanisms described above. Any suitable tool release mechanism and ratchet mechanism can be used. For example, clutch-type ratchet mechanisms may be used instead of the pawl-type ratchet mechanism shown in the drawings. Furthermore, the wrench can take any suitable form, and the invention is not limited to use with sockets. Rather, the invention can be used with tool release mechanisms for any suitable tool, including extension bars, universal joints, bits and numerous other tools. The drive stud can take any suitable shape, and is not required to be square in all embodiments. Other out-of-round shapes suitable for transmitting torque by mating with a female cavity in a driven element may be used, including hexagonal shapes for example. The quick release mechanism can be formed without a control rod of the type described above, and many other mechanical alternatives are possible.

It is not required in all embodiments that the pawl be held in the neutral position by a detent mechanism. The neutral position may be maintained in other ways and by other means, including frictional holding means, for example. Alternately, the pawl may be shaped to be in stable equilibrium when in the neutral position.

The term "coupled" is intended broadly to encompass both direct and indirect coupling. Thus, first and second parts are said to be coupled together when they are directly functionally engaged (e.g. by direct contact), as well as when the first part is functionally engaged with an intermediate part which is functionally engaged either directly or via one or more additional intermediate parts with the second part. Also, two elements are said to be coupled when they are functionally engaged (directly or indirectly) at some times and not functionally engaged at other times.

The term "ratchet direction" is intended broadly to include at least the forward and reverse ratchet functions and the non-ratcheting or neutral ratchet function described above. Thus, a ratchet action is not required for ratchet directions such as the neutral ratchet direction.

The term "position" is intended broadly to encompass a range of positions.

The term "tool release mechanism" is intended broadly to encompass mechanisms that selectively reduce tool retention forces, even if they do not entirely eliminate such retention forces.

The term "mechanical interlock" is intended broadly to encompass mechanical engagement that limits motion of one of the parts in at least one direction.

The foregoing detailed description has described only a few of the many forms that the present invention can take, and should therefore be taken as illustrative rather than limiting. It is only the following claims, including all equivalents, that are intended to define the scope of this invention.

What is claimed is:

1. A ratchet wrench comprising:

a handle comprising a head;

a drive stud rotatably mounted to the head and defining a longitudinal axis;

a ratchet mechanism coupled with the drive stud;

a quick-release mechanism disposed in the drive stud; and an actuator mounted in the handle to move in a plane substantially transverse to the axis, said actuator coupled to the quick-release mechanism to allow user control thereof.

2. The invention of claim 1 wherein said quick-release mechanism comprises a pin slideable in the drive stud along an axis; and wherein said actuator comprises:

a ramp coupled with the pin such that movement of the actuator in the head causes movement of the pin in the drive stud; and a control surface exposed at an exterior portion of the head for contact with a hand of a user.

3. A ratchet wrench comprising:

a handle comprising a head;

a load-bearing element mounted to the head to rotate about an axis;

a drive stud coupled to rotate with the load-bearing element;

a ratchet mechanism coupled with the load-bearing element;

said load-bearing element comprising a first face on a side of the load-bearing element opposite the drive stud, said first face comprising a recess extending around the axis;

said head comprising a non-rotating centering element received in the recess and positioned to resist movement of the load-bearing element in at least one direction away from the axis.

4. A ratchet wrench comprising:

a handle comprising a head;

a load-bearing element rotatable mounted to the head;

a drive stud coupled to rotate with the load-bearing element;

a ratchet mechanism coupled with the load-bearing element;

said load-bearing element comprising a first face on a side of the load-bearing element opposite the drive stud, said first face comprising a recess extending around the axis;

said head comprising a centering element received in the recess and positioned to resist movement of the load-bearing element in at least one direction away from the axis;

a quick-release mechanism disposed in the drive stud, said quick-release mechanism comprising a pin slideable in the drive stud along the axis;

an actuator mounted in the handle to move in a plane substantially transverse to the axis, said actuator coupled with the pin such that movement of the actuator in the head causes movement of the pin in the drive stud.

5. The invention of claim 1 or 4 wherein the head comprises a guide that guides the actuator in sliding movement.

6. The invention of claim 1 wherein the head comprises a centering element extending toward a load-bearing element coupled to rotate with the drive stud, and wherein the load-bearing element comprises a recess in the first face shaped to receive the centering element such that the centering element tends to resist movement of the ratchet wheel in at least one direction away from the axis.

7. The invention of claim 4 or 6 wherein the centering element extends around the axis over more than 180°.

8. The invention of claim 4 or 6 wherein the centering element defines an actuator-receiving region, and wherein the actuator is movable into the actuator-receiving region.

9. The invention of claim 4 or 6 wherein the centering element comprises first and second portions, each portion extending to a separate respective side of the actuator.

10. The invention of claim 4 wherein the load-bearing element comprises a ratchet wheel, wherein the ratchet mechanism comprises a pawl that engages the ratchet wheel, and wherein the actuator is configured never to intersect a line oriented parallel to the axis and passing through an interface between the pawl and the ratchet wheel.

11. The invention of claim 2 wherein the actuator is mounted in the head, and wherein the control surface is exposed at an exterior portion of the head.

12. The invention of claim 1 wherein the actuator is mounted in the head.

13. The invention of claim 4 wherein the actuator comprises a ramp that extends at least partly around an actuator axis, and wherein the ramp is guided in the head for rotational motion about the actuator axis.

14. The invention of claim 3 or 4 wherein the centering element comprises a raised annulus.

15. The invention claim 4 wherein the actuator comprises a ramp that extends at least partly around an actuator axis, and wherein the ramp is guided in the head for rotational motion about the actuator axis, and wherein the centering element comprises a raised annulus extending around the actuator.

16. The invention of claim 8 wherein the centering element extends continuously around the axis.

17. The invention of claim 3 wherein the centering element is load-bearing during at least some operations of the wrench.

18. The invention of claim 4 wherein the actuator comprises a ramp.

19. The invention of claim 18 wherein the actuator further comprises a control surface exposed at an exterior portion of the handle for contact with a hand of a user.

20. In a ratchet wrench of the type comprising: a handle, a drive stud rotatably mounted in the handle, and a ratchet mechanism coupled to the drive stud, the improvement comprising:

a tool release mechanism comprising a tool retention element disposed in the drive stud and a tool release actuator coupled to the tool retention element;

said drive stud coupled with a load-bearing element, said load-bearing element comprising a face on a side of the load-bearing element opposite the drive stud, and a first recess formed in the face;

said wrench comprising a second recess shaped to receive the load-bearing element for rotation about an axis, and a centering element protruding into the first recess;

said centering element being non-rotating and load-bearing to reduce non-centering displacement of the first face with respect to the axis in at least one direction.

21. A ratchet wrench comprising:

a handle comprising a head;

a drive stud rotatably mounted in the head by a load-bearing element that rotates in unison with the drive stud;

a tool release mechanism disposed in the drive stud;

said load-bearing element comprising a face on a side of the load-bearing element opposite the drive stud, and a first recess formed in the face;

said handle comprising a centering element and a second recess shaped to receive the load-bearing element for rotation about an axis, said centering element protruding into the first recess;

said centering element being non-rotating and load-bearing to reduce non-centering displacement of the first face with respect to the axis in at least one direction.

22. The invention of claim 20 or 21 wherein the centering element extends around the axis over more than 180°.

23. The invention of claim 3 or 6 or 20 wherein the load-bearing element comprises a ratchet wheel, and wherein the ratchet mechanism comprises a pawl coupled with the ratchet wheel.

24. The invention of claim 7 wherein the centering element is load-bearing during at least some operations of the wrench.

25. The invention of claim 3 wherein the load-bearing element comprises a ratchet wheel, and wherein the ratchet mechanism comprises a pawl that engages the ratchet wheel.

26. The invention of claim 4 wherein the actuator is mounted in the head, and wherein the actuator is exposed at an exterior portion of the head.

27. The invention of claim 23 wherein the pawl and the ratchet wheel engage one another in a region intersected by a plane oriented transverse to the axis and passing through the centering element.

28. The invention of claim 3 or 6 or 20 wherein the load-bearing element and the ratchet mechanism engage one another in a region intersected by a plane oriented transverse to the axis and passing through the centering element.

* * * * *